US009233465B2

(12) United States Patent
Lai

(10) Patent No.: US 9,233,465 B2
(45) Date of Patent: Jan. 12, 2016

(54) TOOL BOX

(71) Applicant: Chia Wei Lai, Taichung (TW)

(72) Inventor: Chia Wei Lai, Taichung (TW)

( * ) Notice: Subject to any disclaimer, the term of this patent is extended or adjusted under 35 U.S.C. 154(b) by 0 days.

(21) Appl. No.: 14/270,380

(22) Filed: May 6, 2014

(65) Prior Publication Data

US 2015/0321335 A1 Nov. 12, 2015

(51) Int. Cl.

| | |
|---|---|
| ***B65D 85/28*** | (2006.01) |
| ***B25H 3/02*** | (2006.01) |
| ***B65D 43/16*** | (2006.01) |
| ***B65D 55/02*** | (2006.01) |

(52) U.S. Cl.

CPC ..... *B25H 3/02* (2013.01); *B65D 43/164* (2013.01); *B65D 55/02* (2013.01)

(58) Field of Classification Search

CPC ..... B25H 3/02; B65D 55/02; B65D 43/164; Y10S 292/37; Y10S 292/11; Y10S 292/17

USPC ..... 292/137, 138, 163

See application file for complete search history.

(56) References Cited

U.S. PATENT DOCUMENTS

| | | | | |
|---|---|---|---|---|
| 1,639,227 | A * | 8/1927 | Lawrence | 206/373 |
| 4,122,944 | A * | 10/1978 | De Napoli | 206/349 |
| 5,671,856 | A * | 9/1997 | Lisch | 220/4.27 |
| 6,722,524 | B1 * | 4/2004 | Huang et al. | 220/761 |
| 2002/0074332 | A1 * | 6/2002 | Sagol | 220/23.4 |
| 2002/0104709 | A1 * | 8/2002 | Hines | 182/129 |
| 2002/0117413 | A1 * | 8/2002 | Ling | 206/373 |
| 2002/0125160 | A1 * | 9/2002 | Itzkovitch | 206/373 |
| 2003/0000863 | A1 * | 1/2003 | Lee | 206/459.5 |
| 2003/0038142 | A1 * | 2/2003 | Gee | 220/835 |
| 2003/0221984 | A1 * | 12/2003 | Huang | 206/372 |
| 2004/0079662 | A1 * | 4/2004 | Wang | 206/378 |
| 2004/0187256 | A1 * | 9/2004 | Lee | 16/114.1 |
| 2004/0228114 | A1 * | 11/2004 | Chen | 362/84 |
| 2005/0056561 | A1 * | 3/2005 | Lai | 206/373 |
| 2005/0103783 | A1 * | 5/2005 | Bergum et al. | 220/23.86 |
| 2006/0011624 | A1 * | 1/2006 | Shih | 220/4.24 |
| 2008/0083758 | A1 * | 4/2008 | Blendell et al. | 220/522 |
| 2009/0301146 | A1 * | 12/2009 | Jeffries | 70/162 |
| 2009/0314849 | A1 * | 12/2009 | Litten-Brown et al. | 239/1 |
| 2011/0036735 | A1 * | 2/2011 | Cho | 206/349 |
| 2013/0127183 | A1 * | 5/2013 | Chang | 292/202 |
| 2013/0298618 | A1 * | 11/2013 | Gotter | 70/280 |
| 2014/0265197 | A1 * | 9/2014 | Russell et al. | 280/79.3 |
| 2014/0332423 | A1 * | 11/2014 | Lee | 206/349 |
| 2015/0021220 | A1 * | 1/2015 | Cheng | 206/372 |

* cited by examiner

*Primary Examiner* — J. Gregory Pickett
*Assistant Examiner* — Jennifer N Zettl
(74) *Attorney, Agent, or Firm* — Che-Yang Chen; Law Office of Michael Chen

(57) ABSTRACT

A tool box includes a base, a button, a cover and two hinges. The button is located in a recessed area of the base and connected to a fixing member that is connected to the recessed area. The button has a resilient arm extending from each of two ends thereof, and each resilient arm has a protrusion which is engaged with the positioning hole of the fixing member. Two resilient piece extending toward each other from the top edge thereof and a flange extends from one side of the button. The cover is pivotably connected to the base by the two hinges. The cover has a locking member so as to be engaged with the flange of the button. The two resilient piece push the cover upward when the cover is unlocked from the base. The hinges are not loosened after frequent use.

2 Claims, 14 Drawing Sheets

TOOL BOX

BACKGROUND OF THE INVENTION

1. Fields of the Invention

The present invention relates to a tool box, and more particularly, to a tool box wherein the cover slightly pops when the locking member is released.

2. Descriptions of Related Art

The conventional tool box generally comprises a base and a cover which is pivotably connected to one side of the base by a thin plate. The other side of each of the base and the cover has a locking member so as to lock the cover to the base. However, the thin plate is easily broken after frequent open-and-close actions, and the tools in the tool box may suddenly drop from the tool box.

Another conventional tool box 1 is disclosed in FIG. 1 and generally comprises a base 10 and a cover 11 wherein the base 10 has pivotal members 100 on one side thereof. The cover 11 has pivots 110 on one side thereof. The pivots 110 pivotably extend through the pivotal members 100 to pivotably connect the base 10 to the cover 11. The other side of the base 10 has locking members 101 and each locking member 101 has a hole 102. The cover 11 has protrusions 111 on the other side thereof so that the protrusions 111 are engaged with the holes 102 of the locking members 101 to secure the cover 11 to the base 10. However, when the protrusions 111 are disengaged from the holes 102 of the locking members 101, the cover 11 is still covered onto the base 10, the user has to pivot the cover 11 away from the base 10 to access the tools in the base 10. This is not convenient for the users. Besides, the locking members 101 are integral with the base 10 and may be broken after a period of time of use. Furthermore, the pivots 110 are snapped to the pivotal members 100 to close the cover 11, and the pivots 110 are easily loosened from the pivotal members 100 during frequent use.

The present invention intends to provide a tool box to eliminate the shortcomings mentioned above.

SUMMARY OF THE INVENTION

The present invention relates to a tool box and comprises a base having a space defined therein. A recessed area is defined in the first side of the base, and a through hole is defined through an upright wall of the first side of the base. A fixing member is connected to the inside of the upright wall of the first side of the base and located corresponding to the recessed area. Two positioning holes are defined through the fixing member. A button is located in the recessed area and connected to the fixing member. The button has a resilient arm extending from each of two ends thereof. Each resilient arm has a protrusion extending from the inside thereof. The two protrusions are engaged with the two positioning holes of the fixing member. The button has a resilient piece extending from the top edge of each of the two ends thereof. The two resilient pieces extend toward each other. A flange extends from the top side of the button and located beside the two resilient pieces. A cover has a locking member connected to the first side thereof, the second side of the cover 4 is pivotably connected to the second side of the base by two hinges. The locking member is engaged with a lower side of the flange of the button.

Preferably, the base has a first recess defined in the second side thereof and the cover has a second recess defined in the second side thereof. Each of the first and second recesses has a pivot located therein. Each of the pivots has a lip extending radially and outward therefrom. The two hinges are respectively located in the first and second recesses. Each of the two hinges has two reception portions and each of the two reception portions has a reception hole. The two pivots are respectively inserted into the two reception holes. Each of the reception holes has a positioning groove defined in the inner periphery thereof. The two lips of the two pivots are engaged with the positioning grooves respectively.

The primary object of the present invention is to provide a tool box wherein the cover pops upward when the locking member is unlocked.

Another object of the present invention is to provide a tool box wherein the two hinges do not loose between the base and the cover.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
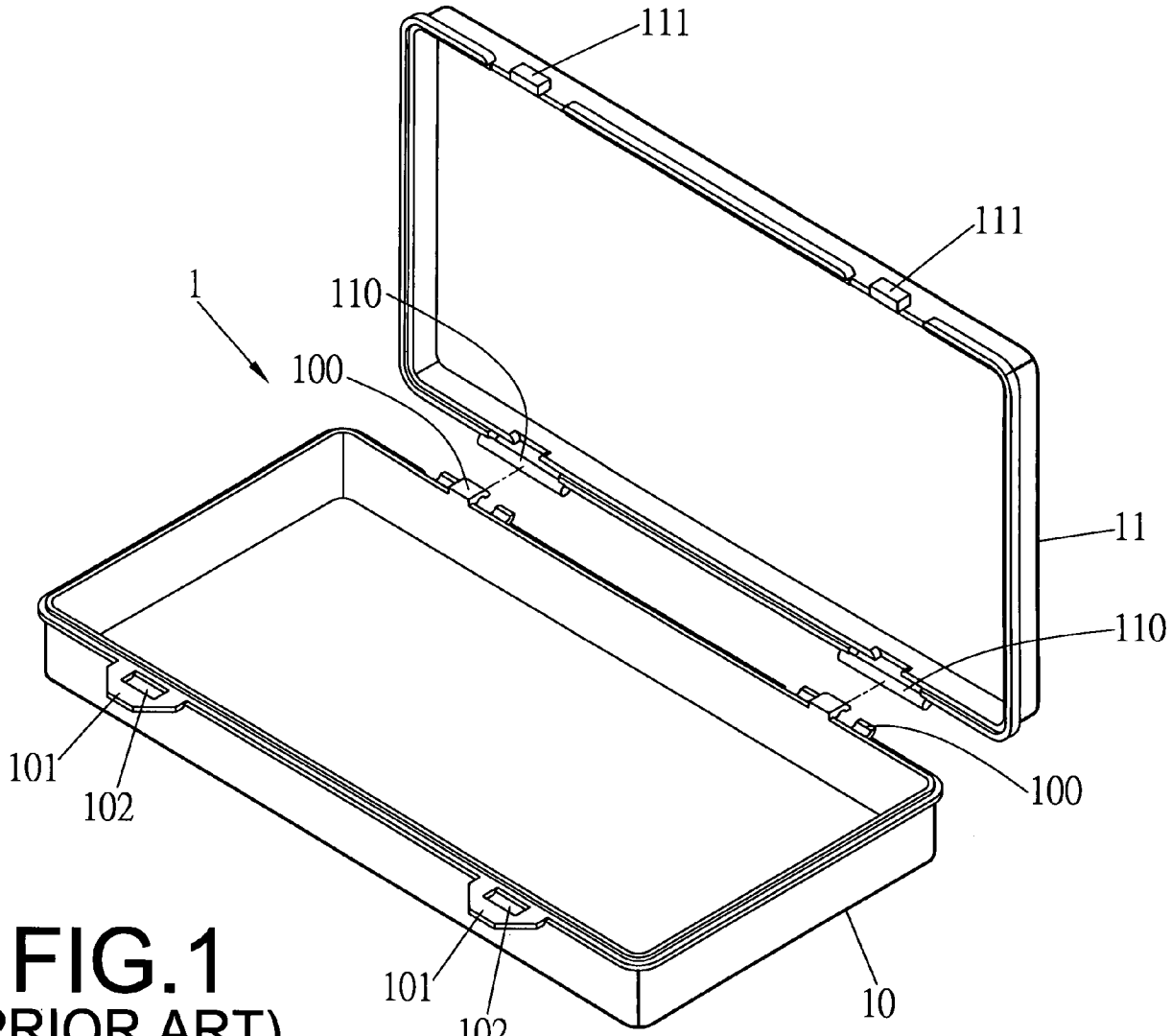
FIG.1 (PRIOR ART)
FIG. 1 is an exploded view of the conventional tool box.
Figure 2:
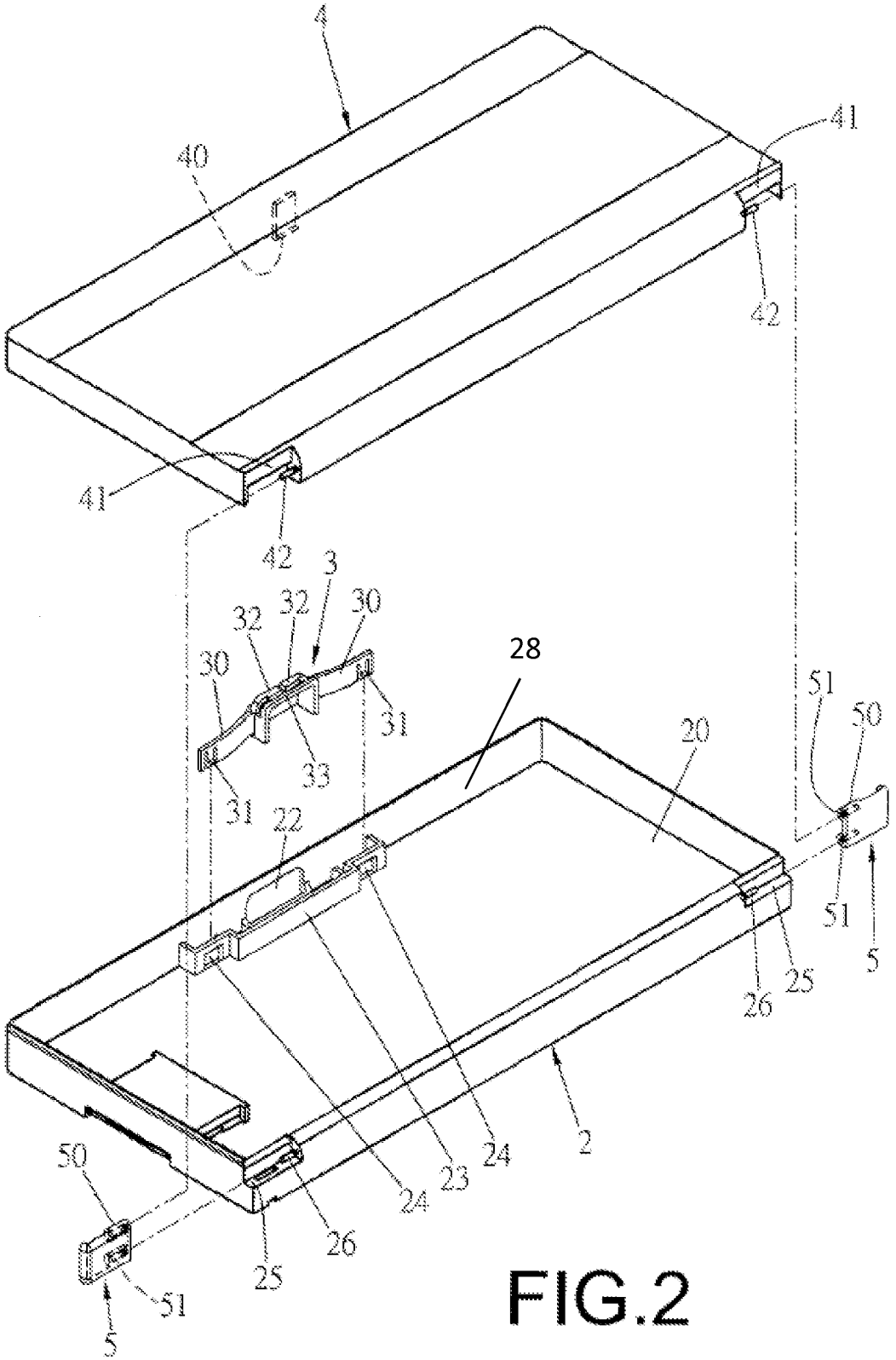
FIG. 2 is an exploded view of the tool box of the present invention.
Figure 3:
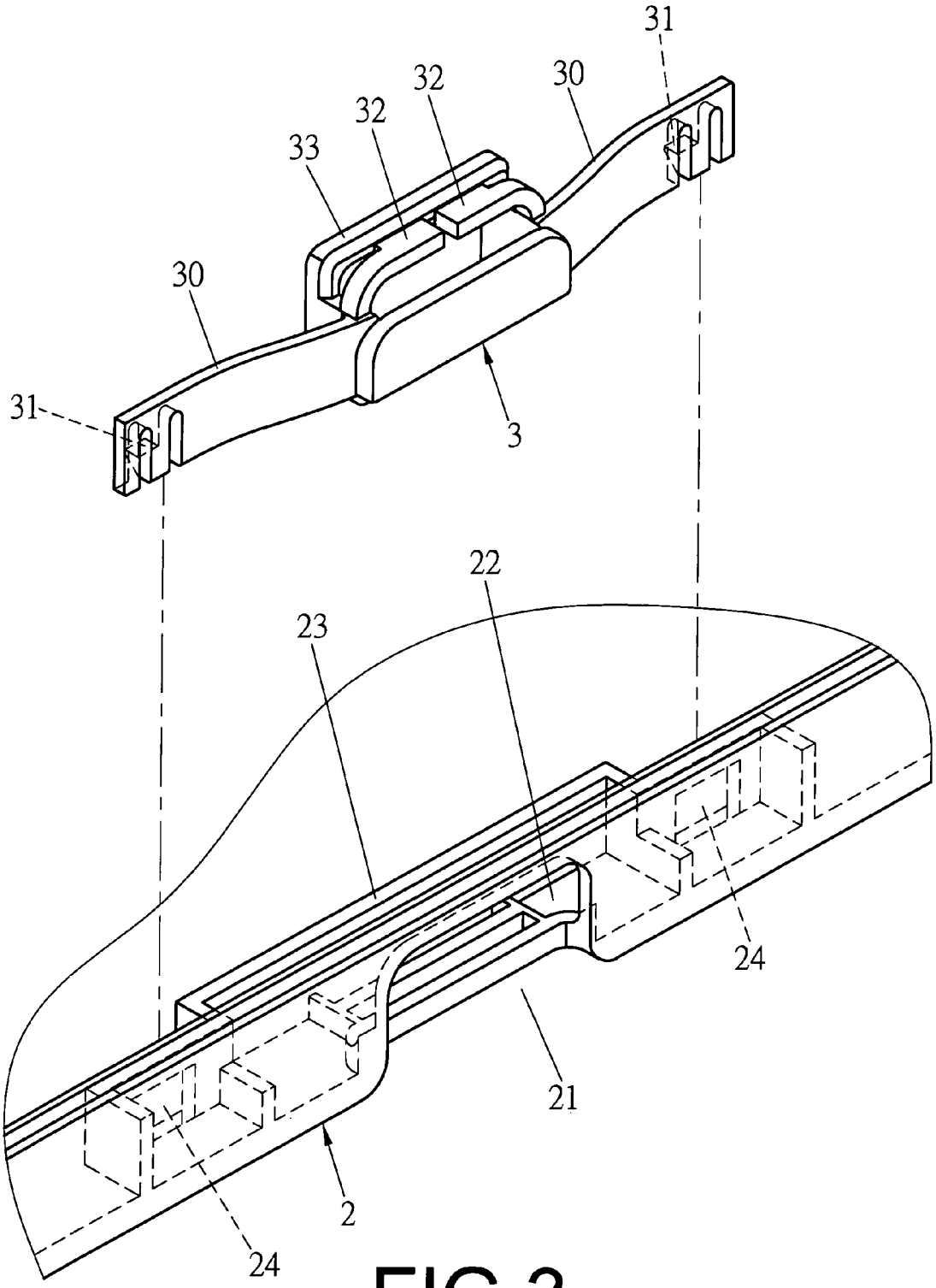
FIG. 3 is an exploded view to show the button and the base of the tool box of the present invention.
Figure 4:
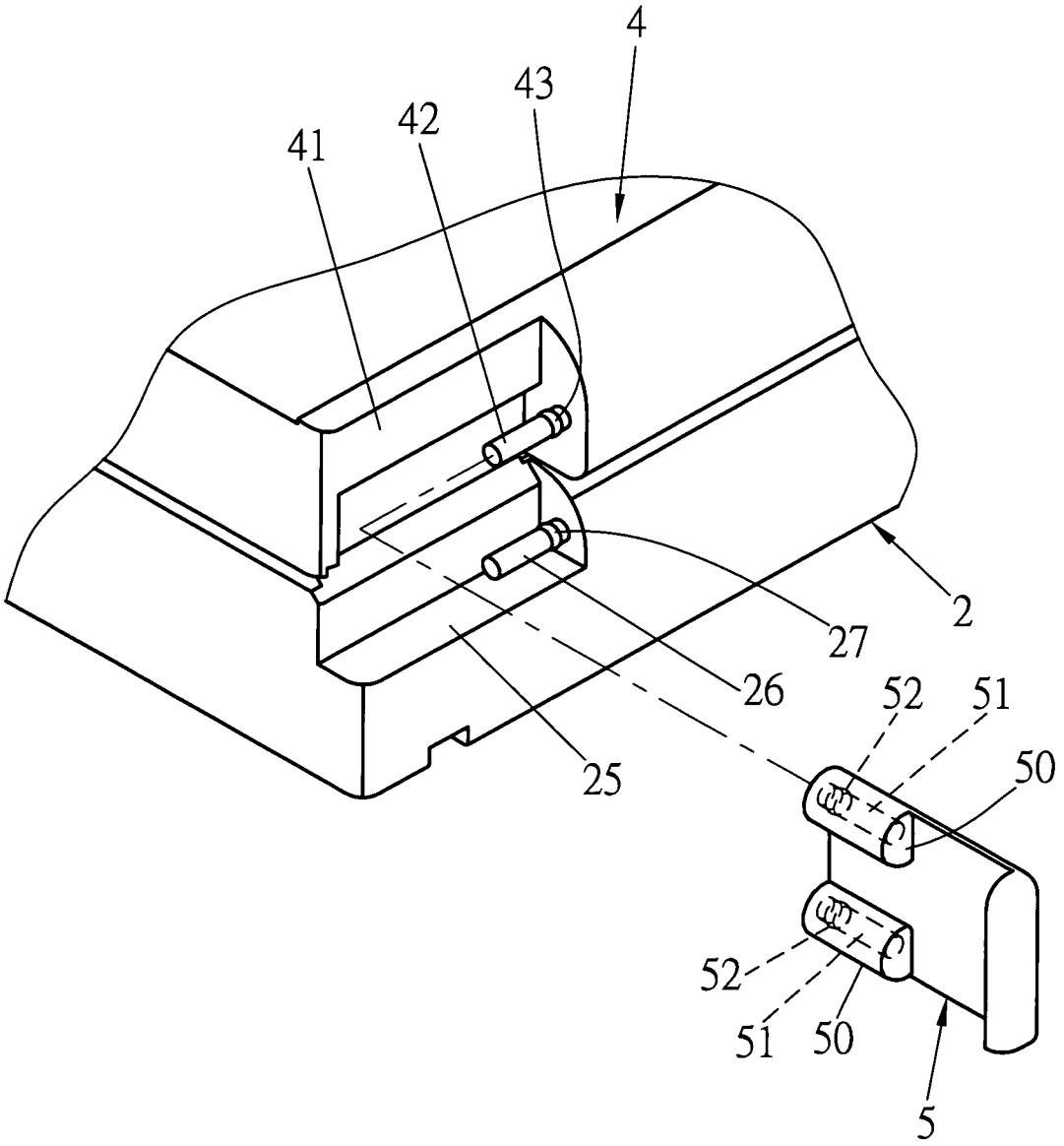
FIG. 4 is an exploded view to show the hinge and the tool box of the present invention.
Figure 5:
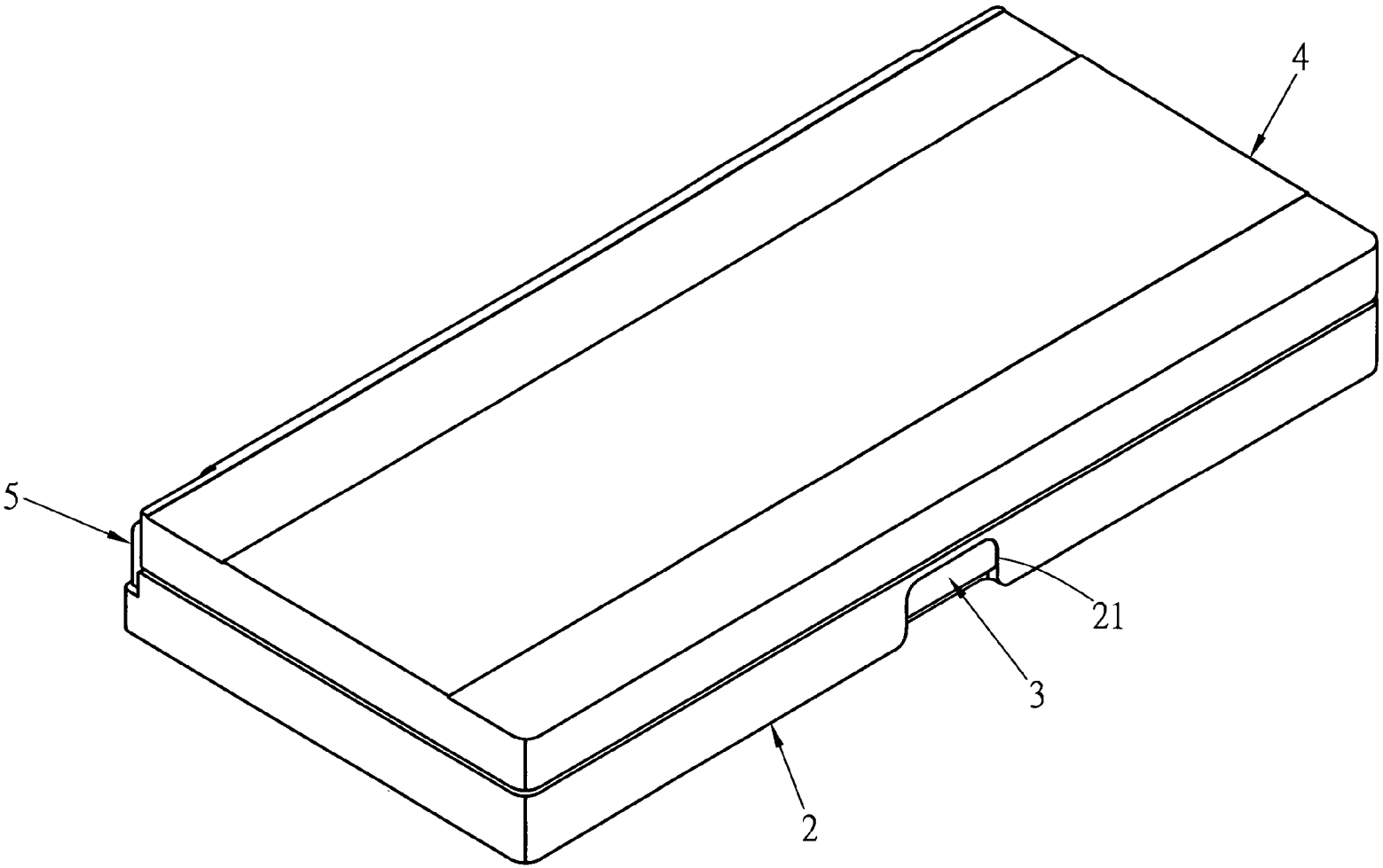
FIG. 5 is a perspective view to show the tool box of the present invention.
Figure 6:
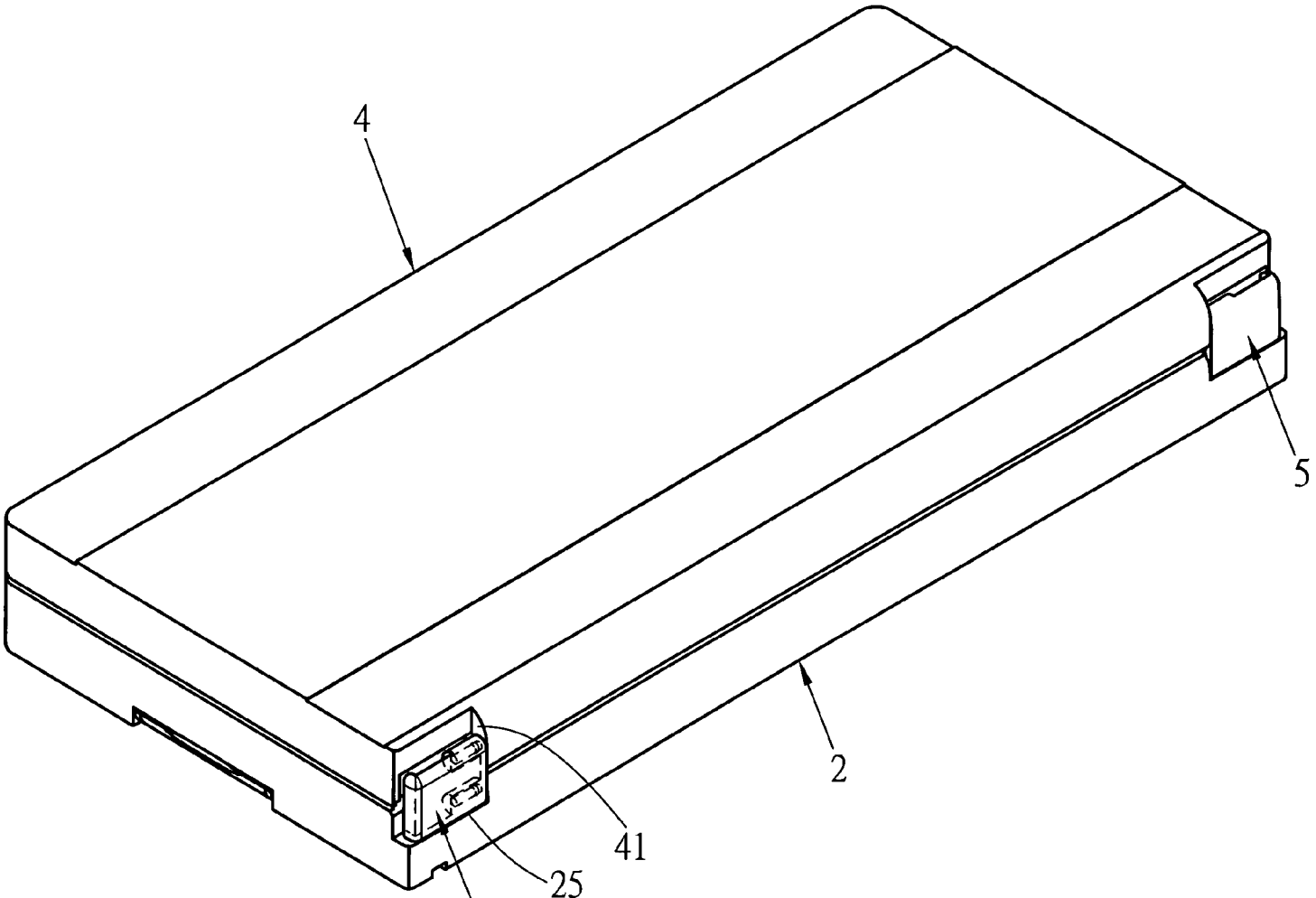
FIG. 6 is another perspective view to show the tool box of the present invention.
Figure 7:
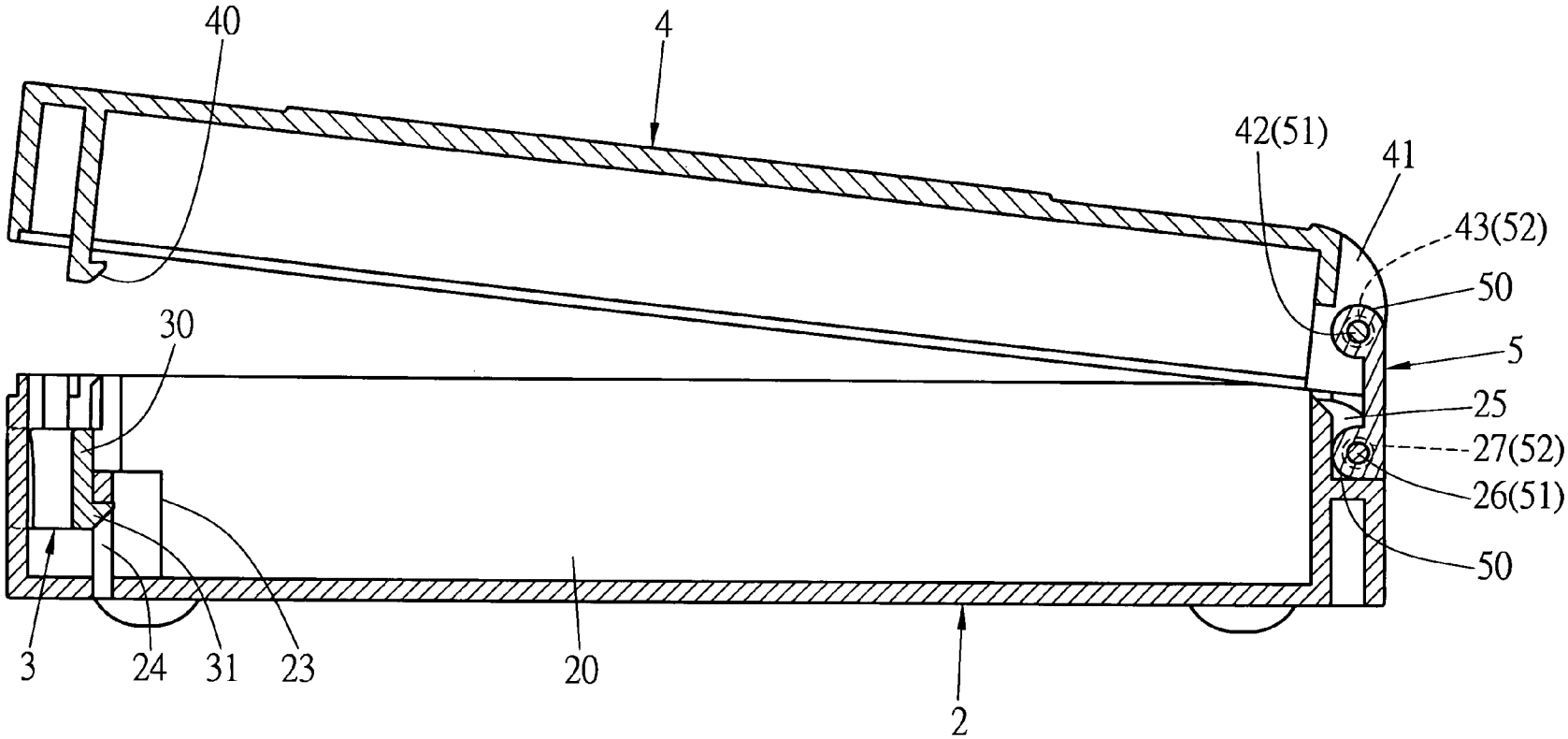
FIG. 7 is a side cross sectional view of the tool box of the present invention.
Figure 8:
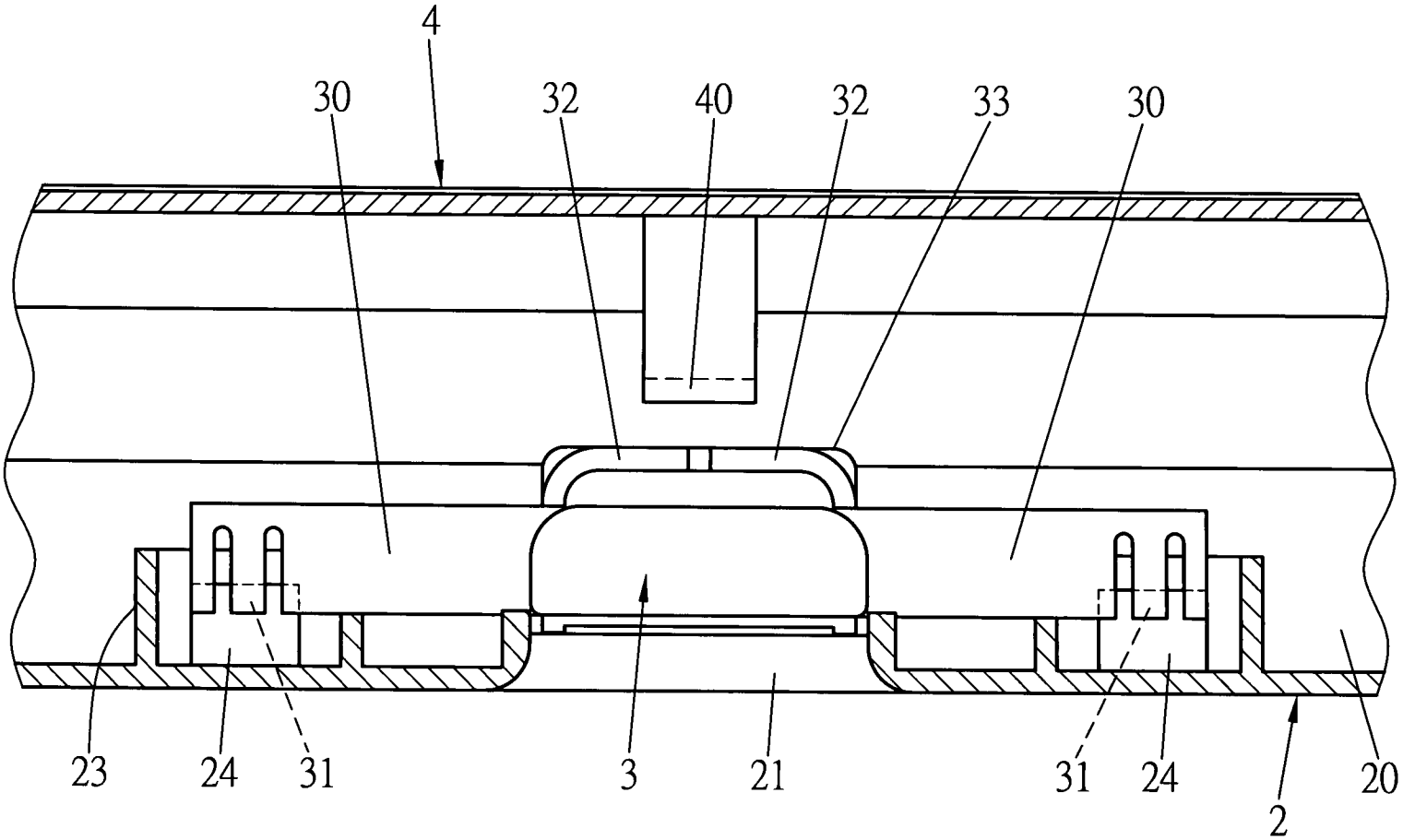
FIG. 8 is a front cross sectional view of the tool box of the present invention.

Referring to FIGS. 2 to 4, the tool box of the present invention comprises a base 2 having a space 20 defined therein so as to receive tools in the space 20. A recessed area 21 is defined in the first side of the base 2 and a through hole 22 is defined through an upright wall 28 of the first side of the base 2. A fixing member 23 is connected to the inside of the upright wall 28 of the first side of the base 2 and located corresponding to the recessed area 21. Two positioning holes 24 are defined through the fixing member 23. The base 2 has two first recesses 25 defined in two ends of the second side thereof and each of the first recesses 25 has a pivot 26 located therein. Each of the pivots 26 has a lip 27 extending radially and outward therefrom as shown in FIG. 4.

A button 3 is located in the recessed area 21 and connected to the fixing member 23. The button 3 has a resilient arm 30 extending from each of two ends thereof, and each resilient arm 30 has a protrusion 31 extending from the inside thereof. The two protrusions 31 are to be engaged with the two positioning holes 24 of the fixing member 23. The button 3 has a resilient piece 32 extending from the top edge of each of the two ends thereof. The two resilient pieces 32 extend toward each other. A flange 33 extends from the top side of the button and located beside the two resilient pieces 32 as shown in FIG. 3.

A cover 4 has a locking member 40 connected to the first side thereof. The cover 4 has two second recesses 41 defined in the second side thereof. Each of the second recesses 41 has a pivot 42 located therein. Each of the pivots 42 has a lip 43 extending radially and outward therefrom, The second side of the cover 4 is pivotably connected to the second side of the base 2 by two hinges 5. The two hinges 5 are respectively located in the first and second recesses 25, 41. Each of the two hinges 5 has two reception portions 50 and each of the two reception portions 50 has a reception hole 51. The two pivots 26, 42 are respectively inserted into the two reception holes 51. Each of the reception holes 51 has a positioning groove 52 defined in the inner periphery thereof. The two lips 27, 43 of the two pivots 26, 42 are engaged with the positioning grooves 52 respectively.

Figure 9:
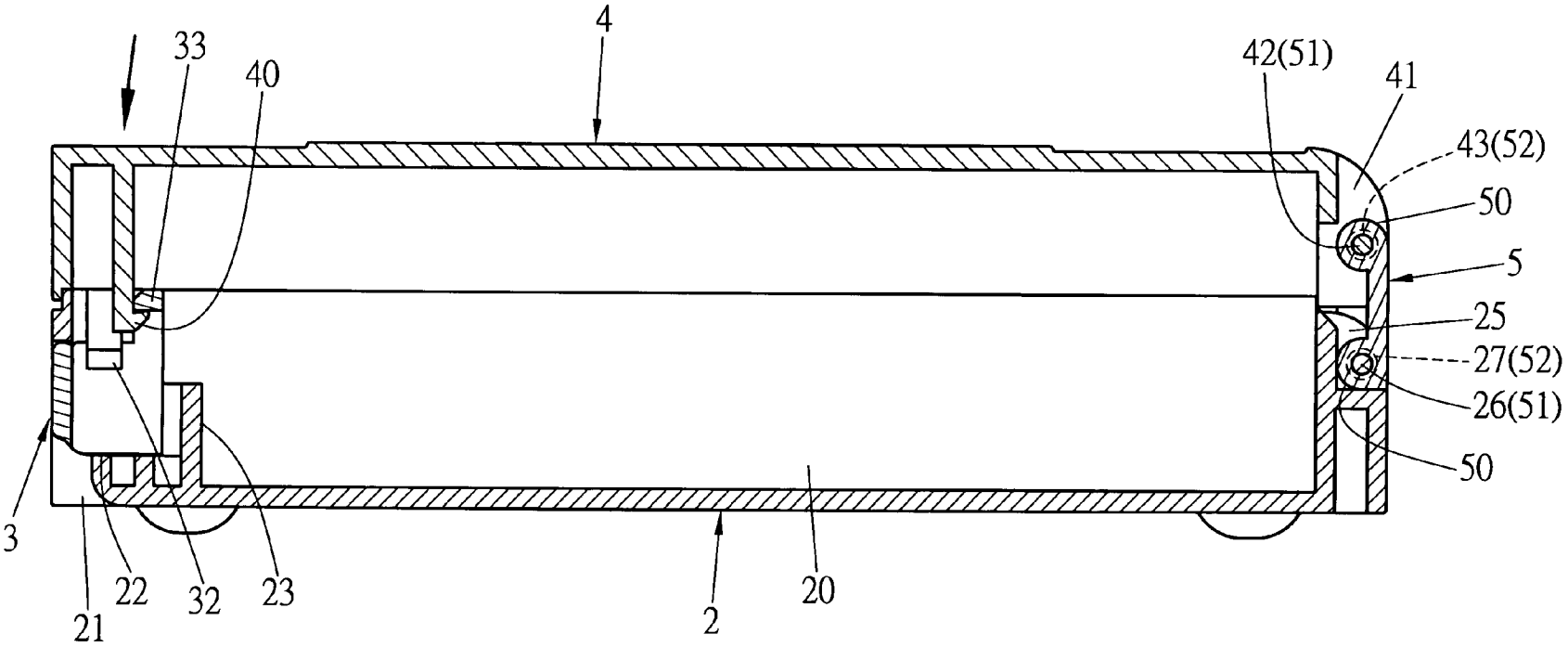
FIG. 9 is a side cross sectional view of the tool box of the present invention, wherein the cover is in locked position.
Figure 10:
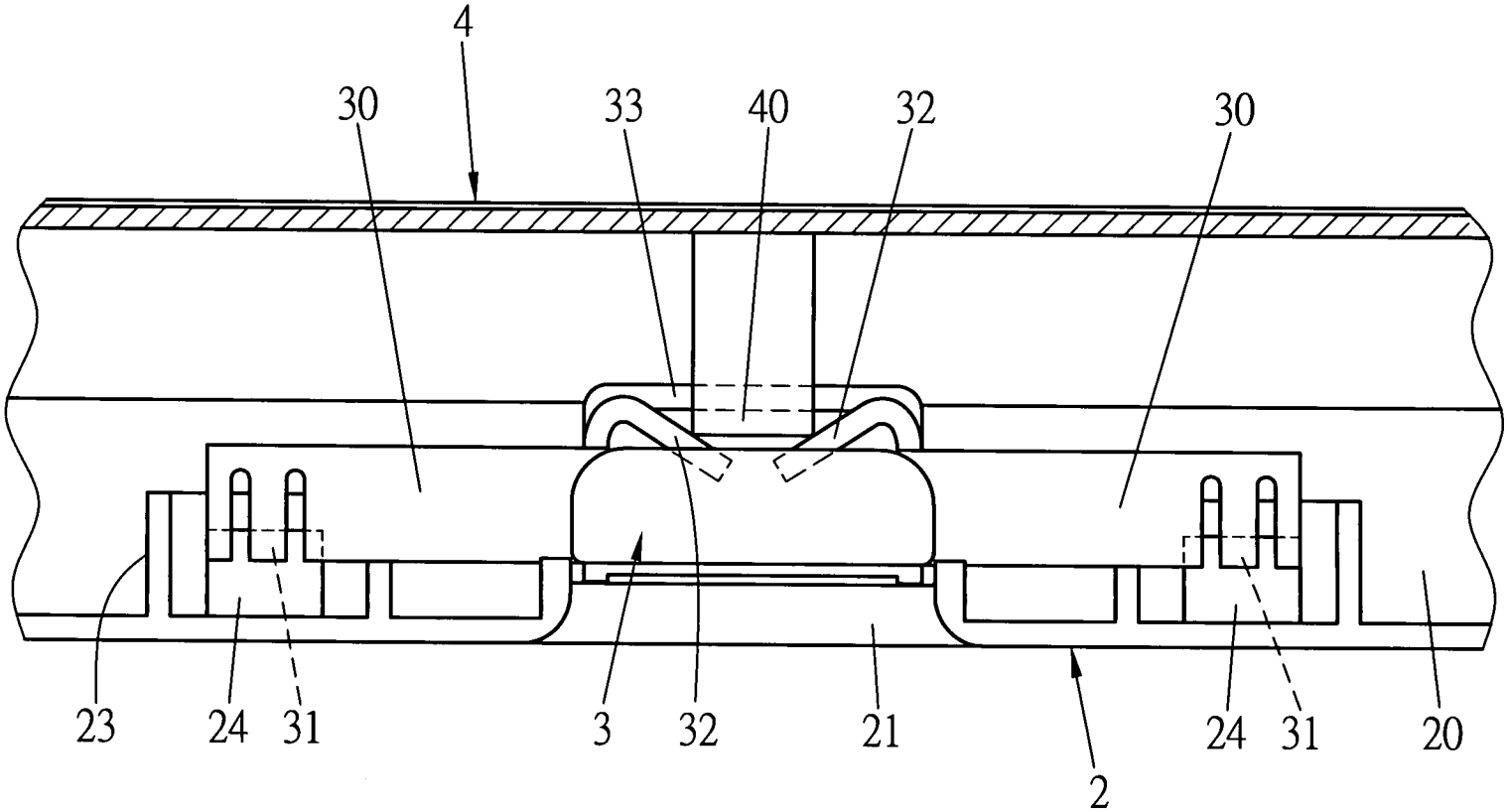
FIG. 10 is a side cross sectional view of the tool box of the present invention, wherein the two resilient pieces are pushed downward by the locking when the cover is in locked position.
Figure 11:
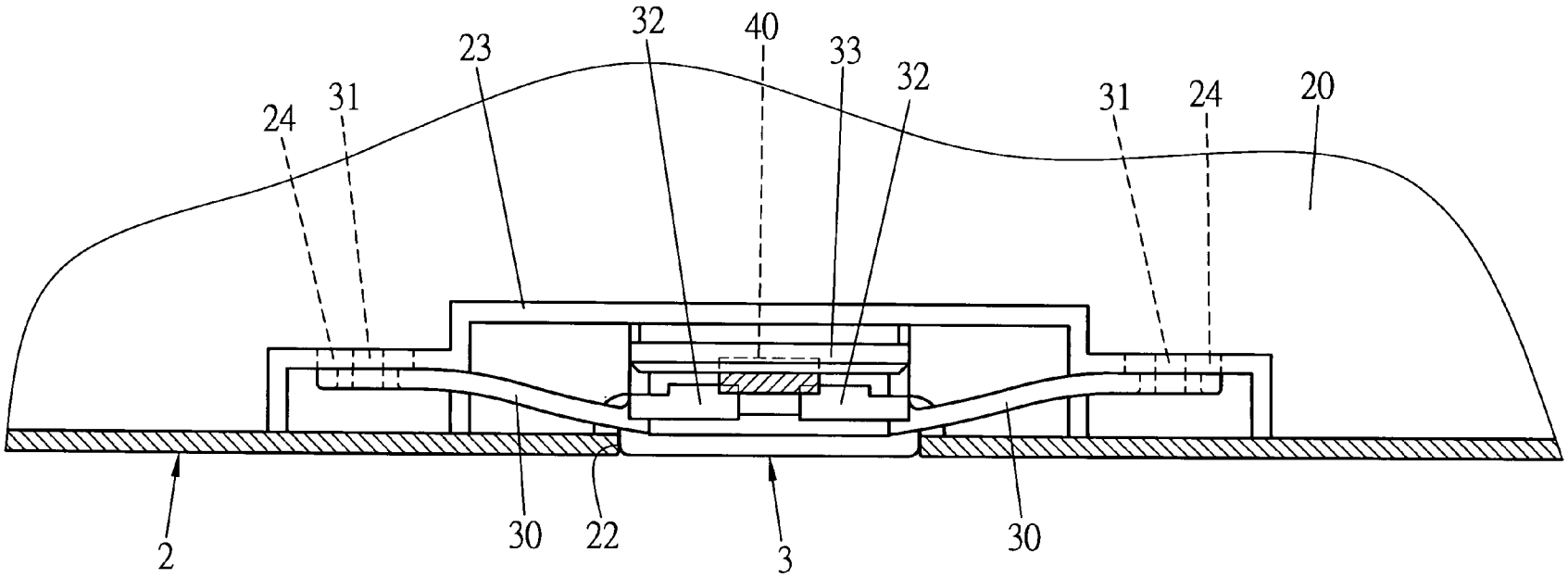
FIG. 11 is a cross sectional view to show that the button is not yet pressed when the cover is in locked position.

As shown in FIGS. 2 to 12, when assembling the tool box, the button 3 is installed to the fixing member 23, and the protrusions 31 of the two resilient arms 30 are engaged with the positioning holes 24 in the fixing member 23. The button 3 is inserted into the recessed area 21 via the trough hole 22 to position the button 3 to the base 2. The cover 4 is then mounted to the base 2, wherein the two second recesses 41 are located corresponding to the first recesses 25. The two pivots 26, 42 are respectively inserted into the two reception holes 51. The two lips 27, 43 of the two pivots 26, 42 are engaged with the positioning grooves 52 respectively. The two hinges 5 are firmly engaged with the first and second recesses 41, 25. The locking member 40 is engaged with the lower side of the flange 33 of the button 3 as shown in FIGS. 9 and 11, and the two resilient pieces 32 are pushed downward and bent by the locking member 40 as shown in FIG. 10. The cover 4 is then securely locked to the base 2.

Figure 12:
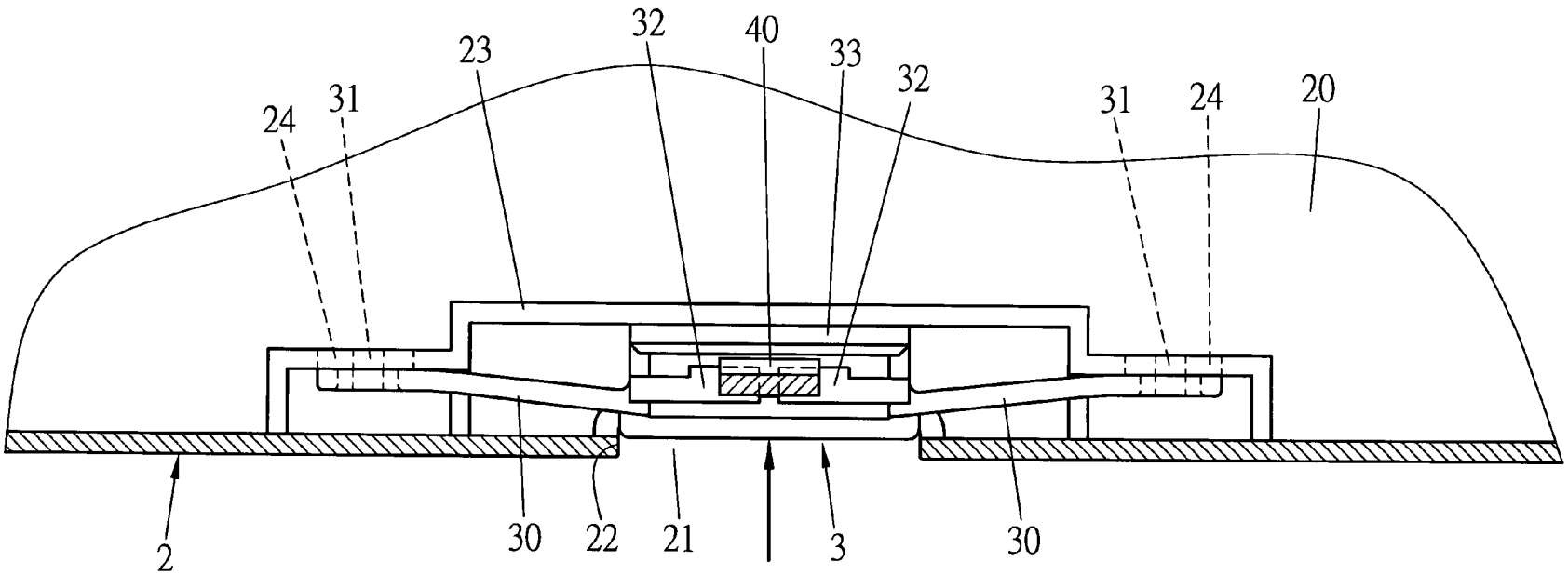
FIG. 12 is a cross sectional view to show that the button is pressed.
Figure 13:
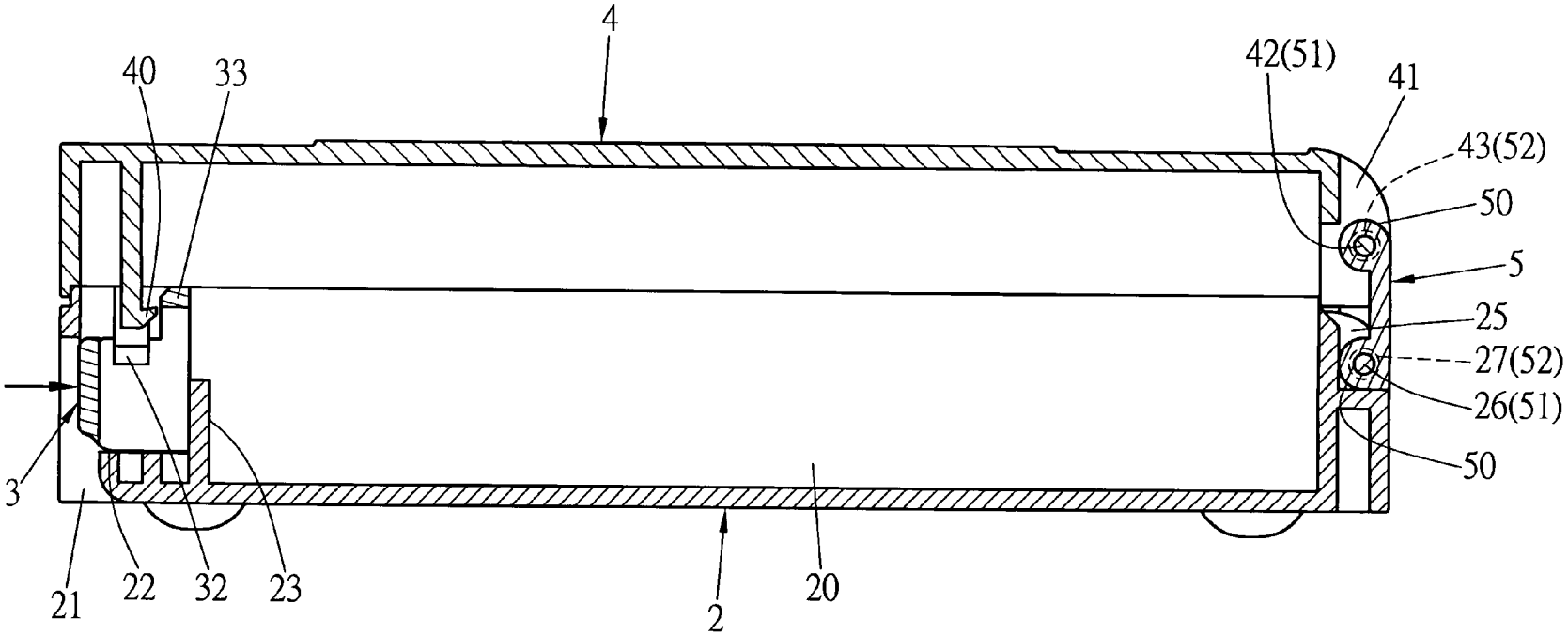
FIG. 13 is a side cross sectional view of the tool box of the present invention, wherein the button is pressed and the locking member of the cover is unlocked.
Figure 14:
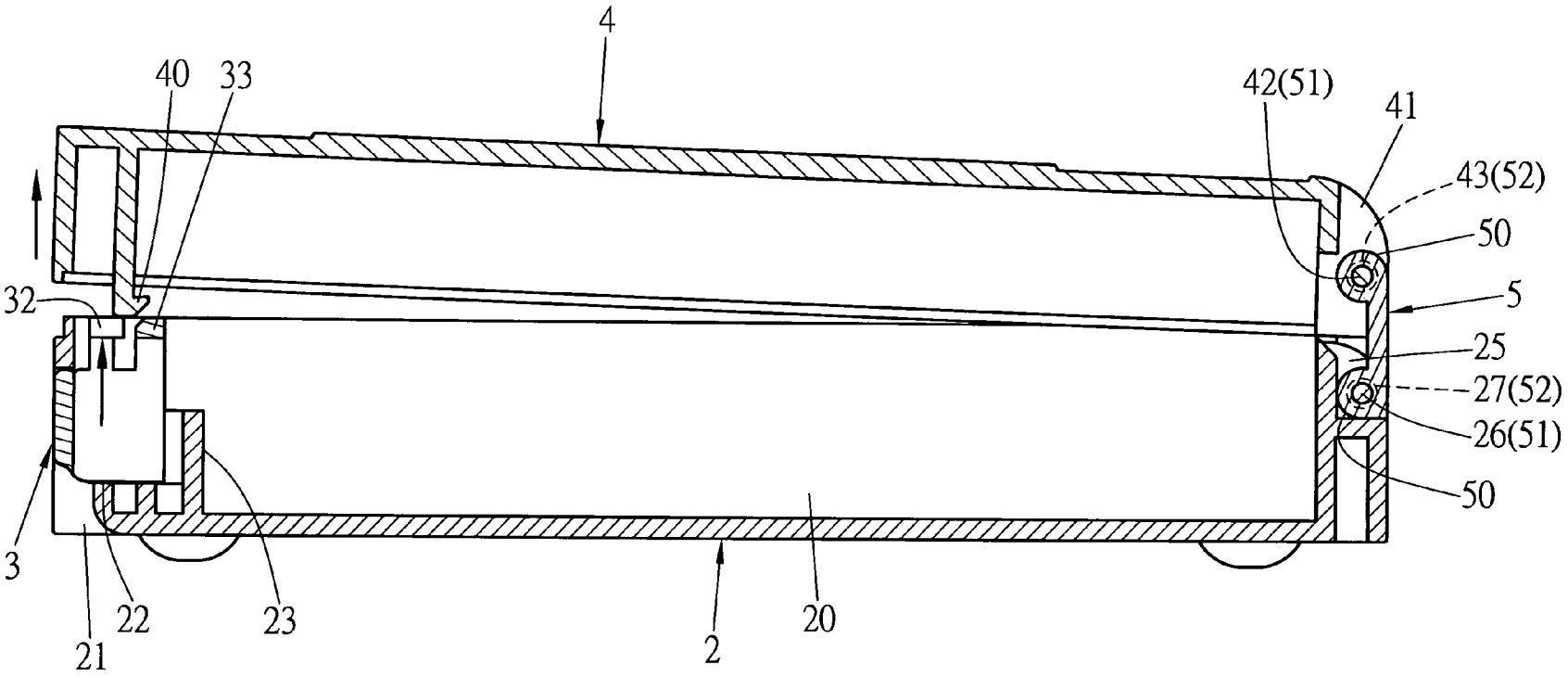
FIG. 14 is a side cross sectional view of the tool box of the present invention, wherein the cover is opened and the two resilient pieces push the cover upward.

As shown in FIGS. 11 to 14, when the user presses the button 3 inward, the two resilient arms 30 are slightly deformed as shown in FIG. 12, and the locking member 40 is disengaged from the lower edge of the flange 33 as shown in FIG. 13. The two resilient pieces 32 then bounce back to push the locking member 40 upward as shown in FIG. 14, so that the cover 4 pops upward. The user can easily open the cover 4. When the button 3 is released, the two resilient arms 30 bounce back to move the button 3 to its initial position as shown in FIG. 11.

Each of the two hinges 5 is firmly connected to the base 2 and the cover 4 by the pivots 26, 42, so that the hinges 5 do not loose and are durable.

While we have shown and described the embodiment in accordance with the present invention, it should be clear to those skilled in the art that further embodiments may be made without departing from the scope of the present invention.

What is claimed is:

1. A tool box comprising:

a base having a space defined therein, a recessed area defined in a first side of the base, a through hole defined through an upright wall of the first side of the base, a fixing member attached to an inner portion of the upright wall of the first side of the base, and wherein two positioning holes defined through the fixing member;

a button located in the recessed area and connected to the fixing member, the button having a resilient arm extending from each of two ends thereof, each resilient arm having a protrusion extending from an inside thereof, the two protrusions engaged with the two positioning holes of the fixing member, the button having a resilient piece extending from a top edge of each of the two ends thereof, the two resilient pieces extending toward each other, a flange extending from a top side of the button and located beside the two resilient pieces, and a cover having a locking member connected to a first side thereof, a second side of the cover pivotably connected to a second side of the base by two hinges, the locking member engagable with a lower side of the flange of the button.

2. The tool box as claimed in claim 1, wherein the base has a first recess defined in the second side thereof and the cover has a second recess defined in the second side thereof, each of the first and second recesses has a pivot located therein, each of the pivots has a lip extending radially and outward therefrom, the two hinges are respectively located in the first and second recesses, each of the two hinges has two reception portions and each of the two reception portions has a reception hole, the two pivots respectively inserted into the two reception holes, each of the reception holes has a positioning groove defined in an inner periphery thereof, the two lips of the two pivots are engaged with the positioning grooves respectively.

* * * * *